United States Patent [19]

Guletsky et al.

[11] Patent Number: 4,993,968

[45] Date of Patent: Feb. 19, 1991

[54] ECONOMICAL CONNECTOR SYSTEM FOR AN ARRAY OF CONDUCTORS

[75] Inventors: Alex W. Guletsky, Tualatin; Scott S. Corbett, III, Lake Oswego, both of Oreg.

[73] Assignee: Precision Interconnect Corporation, Portland, Oreg.

[21] Appl. No.: 317,772

[22] Filed: Mar. 2, 1989

[51] Int. Cl.[5] ..... H01R 13/00

[52] U.S. Cl. ..... 439/492

[58] Field of Search ..... 439/492–499

[56] References Cited

U.S. PATENT DOCUMENTS

| | | | |
|---|---|---|---|
| 3,509,513 | 4/1970 | Russin . | |
| 3,573,719 | 4/1971 | Lightner | 439/494 |
| 3,605,060 | 9/1971 | Praeger et al. | 439/494 |
| 4,066,316 | 1/1978 | Rollings . | |
| 4,076,365 | 2/1978 | Ross et al. | 439/494 |
| 4,269,466 | 5/1981 | Huber | 439/494 |
| 4,335,364 | 6/1982 | Schmitz et al. . | |
| 4,365,856 | 12/1982 | Yaegashi et al. . | |
| 4,579,404 | 4/1986 | Lockard . | |

*Primary Examiner*—Joseph H. McGlynn

*Attorney, Agent, or Firm*—Chernoff, Vilhauer McClung & Stenzel

[57] ABSTRACT

An economical connector for an array of conductors includes a retaining structure on the connector for holding the conductors in parallel alignment with respective terminals which are separate from the retaining structure. This enables simplification of the terminals while also eliminating cable termination and cable preparation steps.

25 Claims, 3 Drawing Sheets

ECONOMICAL CONNECTOR SYSTEM FOR AN ARRAY OF CONDUCTORS

BACKGROUND OF THE INVENTION

The present invention relates to an electrical connector system for terminating a plurality of conductors. More particularly, the invention relates to a connector system which enables the center conductors of coaxial cables to be connected separately to the signal terminals of a connector by a simultaneous operation, without intervening individual coaxial cable preparation or aligning steps, and with a minimum of connector terminal structure. The connector system also enables more efficient termination of the coaxial cable shields.

In the prior art, connectors for terminating a plurality of shielded coaxial cables typically have a connector body with recesses for holding the signal terminals of the connector and for channeling the center conductors to the signal terminals. The terminals for such connectors typically are discrete rigid elements with various structural features that affect the termination method of the connector. For example, some terminals are equipped with tangs designed for insulation penetration, as shown in Yaegashi et al., U.S. Pat. No. 4,365,856, to avoid the loss of time normally required for individually stripping the wires. A primary disadvantage of such terminals is the large start-up expense for the special equipment required to tool such structurally complex terminals. Typically, special equipment is also required to mold multi-chambered insulative bodies to contain such terminals. Additional continuing expenses are associated with large scale manufacturing of numerous discrete terminals involved in multi-step fabrication processes (typically stamping and forming).

A few coaxial cable connectors do not have the disadvantages cited above. For example, in Schmitz et al., U.S. Pat. No. 4,335,364, the signal terminals are thin layers deposited on a connector board. Start-up expenses are kept low because conventional photo-lithographic equipment is used rather than specially built tooling equipment. Additionally, the need for multi-chambered insulative bodies is eliminated. Less expense is associated with depositing or etching the terminals in bulk, simultaneously, rather than individually fabricating and forming them. The disadvantage of such coaxial cable connectors is that they are not readily adaptable to terminating a plurality of cables. If such termination were attempted, the termination time would be excessive because, between each connecting step, where the center conductor of a cable is connected to a signal terminal, an aligning step would be required for aligning the next cable for connection.

Other connectors have multi-function signal terminals that do permit aligning of all of the conductors at once for subsequent connection. For example, in Lockard, U.S. Pat. No. 4,579,404, the conductor aligning step is performed simply by pressing the cables between retaining walls of the signal terminals, thus establishing an interference fit. The center conductors of the cables may then be connected to the signal terminals, for example, by laser welding, without intervening cable aligning steps. Such connectors exemplify efficient use of one element, the signal terminal, which performs a retaining function, a connecting function, and, in Lockard, an extending function (for edge card connection). However, such connectors still require extra expense for special terminal tooling equipment and extra continuing fabrication expense.

Although the discussion so far has focused on the time and expense associated with the conductor alignment and terminal connection steps, there is also time and expense associated with the conductor preparation step before the conductor is even positioned on the connector. Typically, for example, the outer dielectric jacket of a coaxial cable must be stripped to expose the metallic shield underneath, and the inner dielectric layer must be stripped to expose a portion of the center conductor. Inventions such as Yaegashi et al., U.S. Pat. No. 4,365,856, rely on insulation penetration to decrease the time spent individually stripping conductors. With such inventions, the tangs on the signal terminals penetrate the inner dielectric layer to reach the center conductor, thus bypassing the preparatory step of removing the inner dielectric layer. Besides the disadvantage, observed above, of complicating the terminal structure, such a method irreversibly affects the physical integrity of the conductor and produces an extra length of conductor extending beyond the connection point.

SUMMARY OF THE PRESENT INVENTION

It is a primary object of the present invention to provide a connector of simplified, economical structure that enables simultaneous retaining and termination of a plurality of conductors (whether or not joined) with a minimum of assembly steps and equipment. The term "retaining", as used here, is intended to encompass either holding of the conductors for conductor preparation or aligning of the conductors for conductor termination, or both. The term "termination" is intended to encompass electrical connection of either the signal lines or the reference lines, or both.

A first aspect of the present invention avoids the terminal complexity that is normally required when the terminals must perform a retaining function as well as a connecting function in order to enable simultaneous alignment of multiple separate conductors. The present invention eliminates the need for complex and expensive terminal retaining structures by providing a separate retaining means which enables the conductors to be simultaneously terminated because it aligns and holds all of the conductors so that they may be electrically connected at once. A time-consuming series of "alignment and connect" steps, one step for each respective cable, is therefore avoided. In addition to aligning the conductors for simultaneous electrical connection, the separate retaining means also holds the conductors for simultaneous cable preparation. Dielectric and/or shielding material may be removed from the conductors as they are held in parallel arrangement by the retaining means, while the retaining means is either on or off the connector body, thus eliminating the need for external retaining equipment for the preparation step. Additionally, the following combination of secondary advantages are also realized:

(a) simplification of the multiple terminals to strip-like structures which permit a less expensive, nonindexing, method to be used for the step of simultaneous electrical connection;

(b) enablement of a single piece of termination equipment to make both the signal and shield connections when coaxial cables are used;

(c) exposed signal terminals and exposed stripped coaxial shield portions, permitting open viewability for quality inspection;

(d) a parallel relationship between the incoming conductors, the major plane of the connector body, and the terminals, thereby eliminating any need to bend the conductors and permitting close stacking of multiple connectors;

(e) strain relief at the retaining means to protect individual connected conductors against longitudinal forces.

The foregoing and other objectives, features and advantages of the invention will be more readily understood upon consideration of the following detailed description of the invention taken in conjunction with the accompanying drawings.

Figure 1:
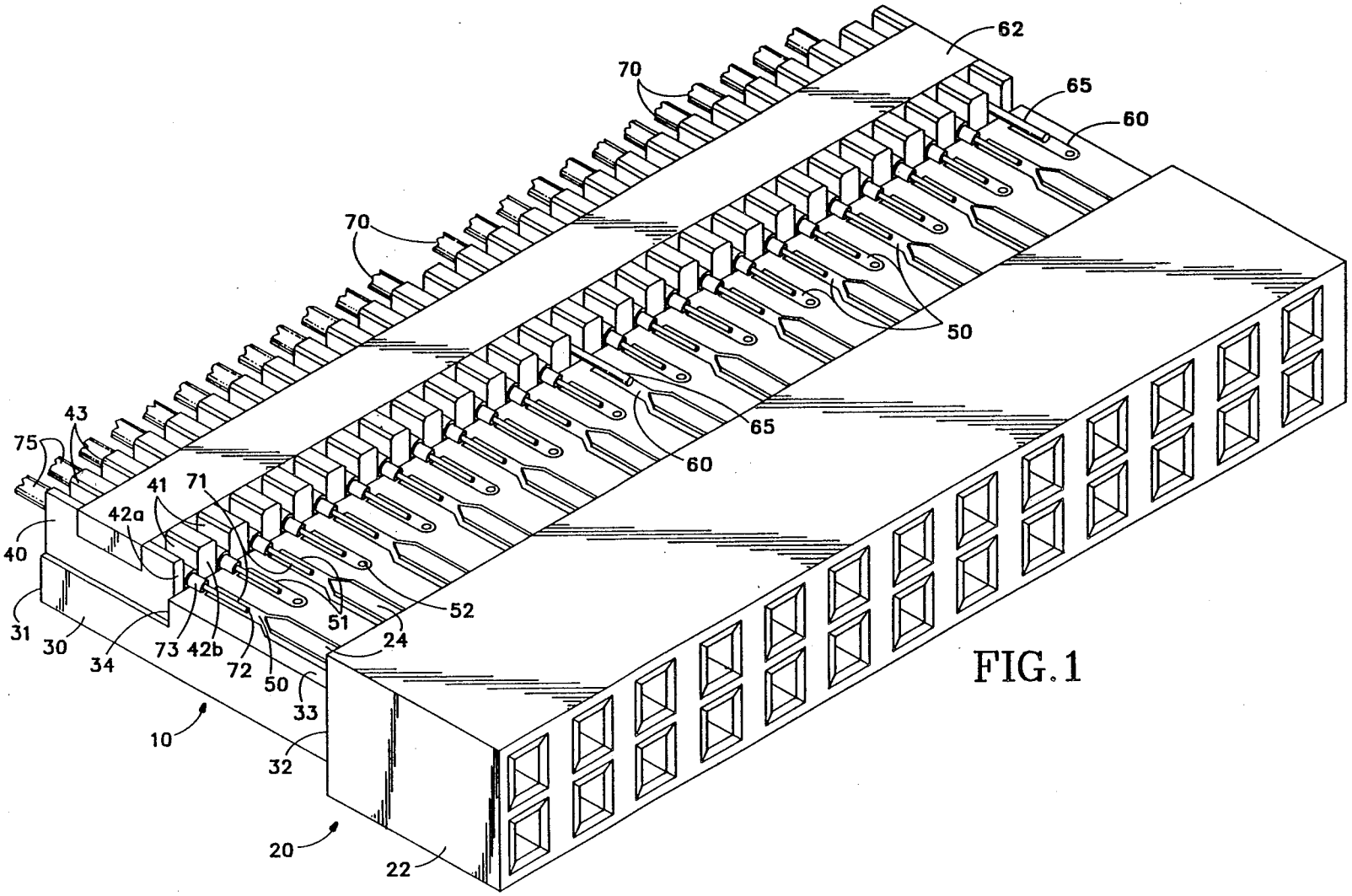
FIG. 1 is a perspective view of a preferred embodiment of the connector of the present invention mated with a conventional, edge-card-mounted receptacle.

FIG. *2a* is a partial top view of the embodiment of FIG. 1.

FIG. *2b* is a partial bottom view of the embodiment of FIG. 1.

Figure 3:
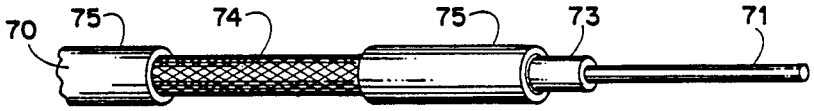

FIG. 3 is a perspective view of an exemplary coaxial cable that has been prepared in advance for positioning on the embodiment of FIG. 1.

FIGS. *4a* and *4b* are sectional views, taken along line A—A of FIG. *2a*, showing the sequence of a novel method of coaxial cable preparation whereby the preparation occurs after positioning of the conductors on a retainer, and before the interconnection of the shields.

Figure 5:
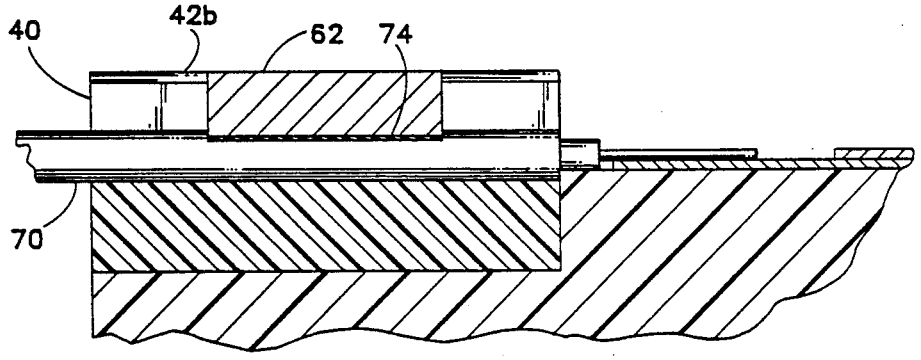

FIG. 5 is a sectional view, taken along line A—A of FIG. *2a*, of a preferred means for achieving the interconnection of the shields.

DETAILED DESCRIPTION OF THE INVENTION

Referring to the drawings, and in particular to FIG. 1, a connector 10 for an array of conductors is shown in association with an optional, conventional, edge-card-mounted receptacle 20. In the preferred embodiment depicted here, the plurality of conductors are primarily the center conductors 71 of shielded coaxial cables 70, although the conductors may alternatively be of other noncoaxial types The conventional edge-card-mounted receptacle 20 comprises a receptacle body 22 and top and bottom rows of solder tails 24 of which only the top row can be seen in FIG. 1. The connector 10 may, alternatively, mate to other known devices such as, for example, a flexible circuit. The connector 10 is comprised of a dielectric connector body 30, a retainer 40, preferably reference terminals 60 (two are shown in the figure) and spaced-apart signal terminals 50. FIG. 1 also shows an optional ground bar 62 which ensures the electrical interconnection of the metallic shields (not shown in FIG. 1) of each of the coaxial cables for grounding purposes and for strain relief. FIG. 1 depicts the connector body 30 as a dielectric board; however, another type of supporting structure, such as a flexible circuit, may alternatively be utilized. FIG. 1 also depicts the retainer 40 as permanently attached to the board, but the retainer may initially be detached from the board to facilitate initial coaxial cable retention and/or preparation, particularly where simultaneous removal of more than the outer dielectric jacket 75 is desired. The retainer 40 is preferably a comb-shaped member, although other shapes are possible.

In the use of the connector 10, each coaxial cable from a plurality of coaxial cables 70 to be terminated is pressed into a respective slot 41 defined by a pair of opposing retaining walls 42*a* and 42*b* that constitute comb teeth on the retainer 40. The slots 41 are slightly narrower than the outer diameter of the resilient cable jackets 75 and thus frictionally hold each of the coaxial cables parallel to each other with a predetermined retaining force. This retaining force is sufficient to hold the coaxial cables while the coaxial cables simultaneously have their ends cut, simultaneously have their dielectric material (outer dielectric jacket 75 or inner dielectric 73) stripped off, simultaneously have their metallic shields interconnected and/or simultaneously have their center conductors 71 connected. These processes are described in further detail below. If the coaxial cables have been stripped and cut before placement on the retainer, each coaxial cable should be positioned longitudinally, while being pressed into an individual slot 41, so that the end 72 of the center conductor 71 of each coaxial cable extends beyond the retainer a distance sufficient to overlap a separate signal terminal 50 at a desired contact area 51. This is best shown in FIG. *2a*. The beveled corners 43 of the retaining walls 42*a* and 42*b* are designed to facilitate the pressing of each coaxial cable into a slot 41. In this particular embodiment, the ends of the conductors are not joined to one another, such as by a ribbon cable or flexible circuit arrangement, where an insulative casing surrounds the conductor ends and securely holds them in parallel position relative to one another If joined conductors were employed, a retainer 40 without teeth would be preferable, although such a retainer still must perform alignment and securement of the conductors (preferably both shields and center conductors) relative to the connector body for the conductor connection step. Although the retainer 40 could be constructed of a conductive material, it is preferable to use a convenient dielectric material such as moldable plastic so as to reduce fabrication and material expense.

The connector body 30 has a receiving edge 31 which is the first edge on the connector body 30 that is passed by the conductors as they are positioned on the connector body, and the retainer 40 is located adjacent to this receiving edge The connector body is free of any overhanging structures that might interfere with access to the signal terminal contact areas 51, thereby providing a means for exposing all of the desired contact areas 51 for simultaneous inspection and connection of the signal conductors 71. Also, the planes of the contact areas 51 are substantially parallel with the direction in which the coaxial cables are held by the retainer 40, which gives the connector 10 a low profile suitable for stacking of individual connectors, and eliminates any need to bend the coaxial cables 70.

Figure 4A:
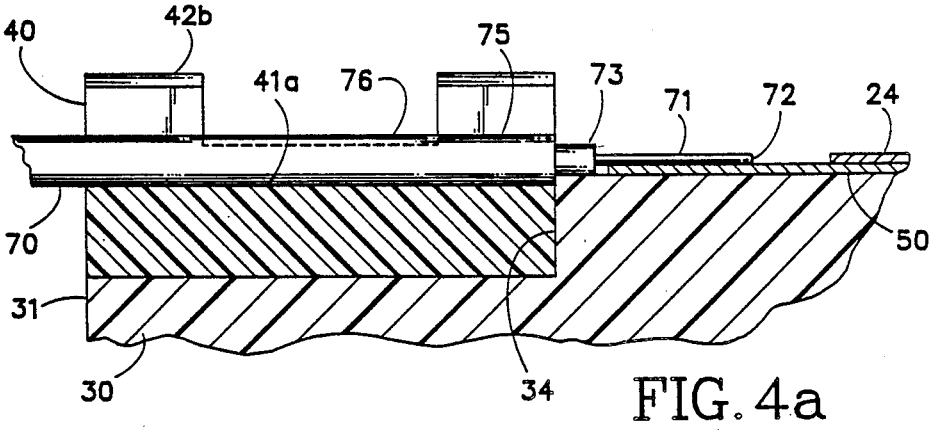

Preferably, the connector body also includes a ledge 34. In the preferred embodiment shown in FIG. 1, the inner dielectric 73 of each coaxial cable 70 rests on this ledge, while the outer dielectric jacket 75 abuts against the ledge. During stripping of the coaxial cables, thin "hairs" of wire may twist off the metallic shields of the cables and extend adjacent to the center conductors 71 of the cables along a portion of a signal terminal 50. The colored inner dielectric 73 allows for detection and removal of these stray hairs thus preventing a short between the reference and signal paths. The most significant purpose of the ledge 34, however, is to minimize the distance between the center conductors 71 of the coaxial cables and the contact areas 51 of the signal terminals 50 by transversely offsetting the signal terminals from the coaxial cable supporting surfaces 41*a* at the bottom of each slot 41 of the retainer 40, as best shown in FIG. 4*a*, to enable substantial abutment of the conductors 71 with the signal terminals.

In the preferred embodiment shown in FIG. 1, the signal terminals 50 are simple strip-like structures made of a conductive material. Although some forms of the invention could encompass more complicated signal terminal structures, such as slotted or crimping contacts, a principal object of the invention is to reduce signal terminal fabrication expense, and therefore simple signal terminal structures are preferred. It is also preferred that the signal terminals 50 be deposited on the connector body 30 because conventional photolithographic or spraying equipment may be used to deposit very thin layers. Preferably, the signal terminals 50 are also flat, as shown in the figures, facilitating the use of external connecting equipment to make the connections between the center conductors 71 and the signal terminals 50. The signal terminals 50 are shown as being on the same plane as the reference terminals 60, which enables connection of the signal and reference terminals, respectively, simultaneously by means of the same equipment. The dimensions of the signal terminals 50, the relative arrangement and number of the reference terminals 60 with respect to the signal terminals 50, and the dielectric constant of the connector body 30 may be chosen to provide a desired characteristic impedance or other electromagnetic property.

Figure 2A:
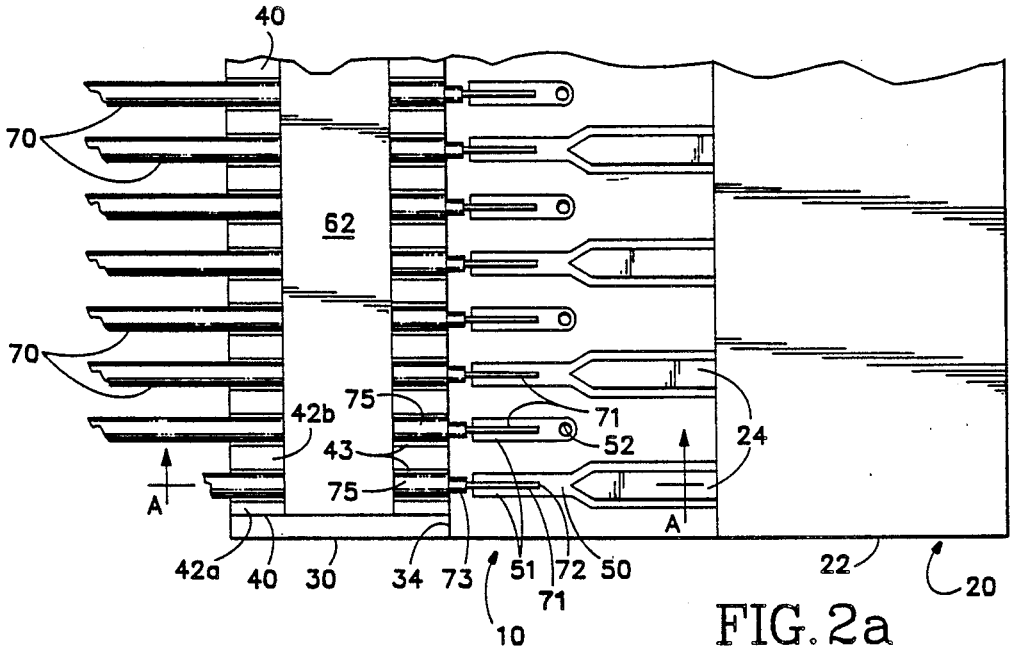
Figure 2B:
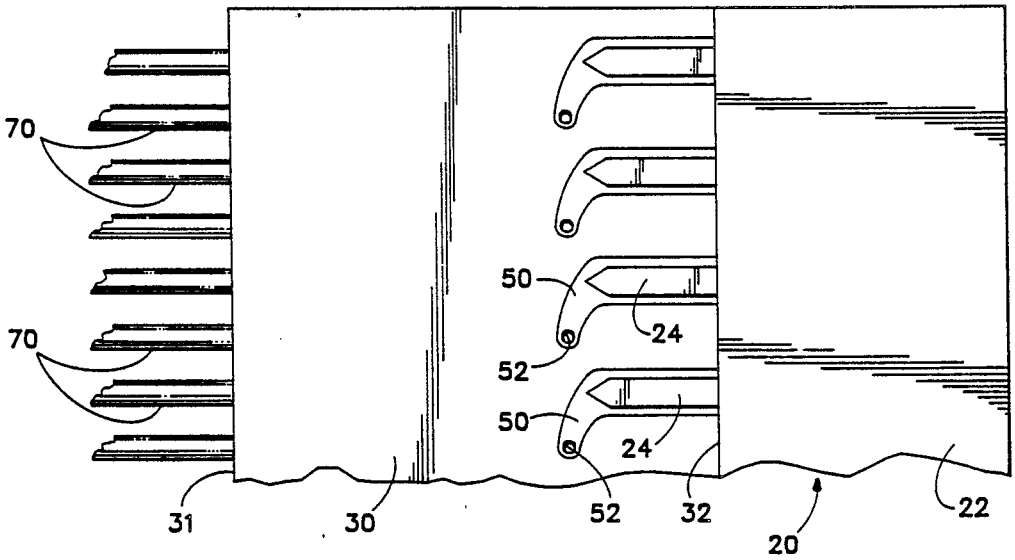

FIG. 2*b*, a bottom view of the preferred embodiment, illustrates how every other one of the spaced-apart signal terminals 50 may pass to the bottom of the connector body 30 through a plated-through hole 52 and curve in a direction that finally ends in alignment with each solder tail 24 on the bottom of the connector body. This layout achieves maximum utilization of the solder tails 24 of a conventional edge-card-mounted receptacle 20. A translucent dielectric covering and/or shield structure (not shown) may preferably be placed over the connector body 30 to protect the signal traces 50 from contact with external metallic objects that might short the signal, to provide a shielding means against externally generated signals, or to obtain another particular electromagnetic property.

Referring to FIG. 1, the step of electrically connecting the metallic shields of the cables 70 to the reference terminals 60 is facilitated by the ground bar 62 and by bare conductor wires 65. The termination process that connects the center conductors 71 of the coaxial cables to the signal terminals 50 may also serve to connect the bare conductor wires 65 to the reference terminals 60. Furthermore, if a layer of solder is predeposited on the ground bar 62, so that the ground bar 62 will connect to the exposed metallic shields of the coaxial cables 70 upon application of heat, some of the solder will flow to the surface of each bare conductor wire 65 and establish electrical connection despite the narrower diameter of the bare conductor wire 65 relative to the diameter of the outer dielectric jacket 75 of the coaxial cables 70. The ground bar/bare conductor wire approach eliminates the need for separate connecting steps that would be peculiar to the reference terminals 60.

There are alternate means for electrically connecting the metallic shields of the coaxial cables 70 simultaneously to the reference terminals 60. One alternate grounding system is to employ conductive extensions included on the ground bar 62 that would connect with the reference terminals 60 in substitution for the bare conductor wires 65. Although the ground bar shown in FIG. 1 is depicted as a solid conductive bar, the ground bar may also be fabricated utilizing circuit board technology (flexible or otherwise) with conductive traces patterned on a substrate arranged so that individual shields 74 are simultaneously terminated to the reference terminals 60 through the conductive traces. This last-mentioned approach enables a variety of grounding configurations, including noncommon or common ground termination, depending on the requirements of the application which may include minimizing crosstalk, controlling impedance, optimizing lead density and providing for a preassigned terminal designation.

Figure 4B:
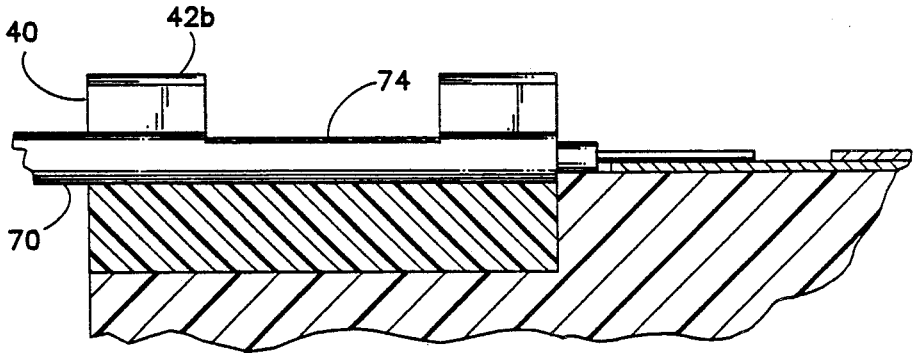

A principal feature of the present invention is that it permits a reduction of the number of steps required in cable preparation. A typical coaxial cable 70 is shown in FIG. 3 comprised of a center conductor 71, an inner dielectric 73, a metallic shield 74 (solid, woven, foil, etc.) and an outer dielectric jacket 75. FIG. 3 depicts the coaxial cable after it has been prepared (stripped) in a conventional manner and is ready to be positioned on the connector body. Conversely, FIGS. 4*a* and 4*b* depict a cable 70 being prepared by a new method made possible by the present invention. In FIG. 4*a* the retainer is shown already mounted on the connector body 30 (although it may alternatively be detached therefrom) with the coaxial cables already having their ends 72, inner dielectric material 73 and center conductors 71 prepared either conventionally or by an additional innovative method described in the next paragraph. The cables 70 are positioned in their respective individual slots 41 in the retainer 40, so that all the cables are substantially parallel to each other. Thereafter, dielectric material is removed from the outer dielectric jackets 75 of each of the coaxial cables, thus reducing the time involved in cable preparation before termination. The retainer 40 aids in this outer dielectric removal step because the retainer securely holds each cable at the receiving edge 31 of the connector body 30 near where the dielectric material to be removed is located The step of removal is preferably done by directing a laser beam sequentially at each outer dielectric jacket so that a window is melted in the outer dielectric jacket 75 at the position indicated as 76 in FIG. 4*a*, exposing the metallic shield 74 (FIG. 4*b*) underneath. An alternative method of performing the removal step is to remove dielectric jacket material from each cable simultaneously. This may be performed with a long heating iron that melts off the outer dielectric jacket. Other alternative removal steps might rely on forced air heat or mechanical cutting.

To expose the inner dielectric material 73 and the center conductor 71 (either before or after the removal of the outer dielectric material 75) the coaxial cables may be placed into the retainer prior to the attachment of the retainer to the connector body. The discrete coaxial cables are frictionally held by the retainer such that simultaneous cutting and removal of inner and outer dielectric and conductive material is possible, thus greatly reducing the time involved with cable processing before termination. The selective removal of dielectric and conductive material can be accomplished by means of a heated set of mechanical cutters, with holes patterned in the blades at spacings similar to the spacings of the cables mounted in the retainer. By using different blades, each with cutting holes of a dimension determined by the diameter of the material to be stripped, the inner dielectrics 73 and center conductors 71, of the cables can be exposed to facilitate termination. With either or both of the methods discussed in this and the previous paragraph, the conventional extra step of individually guiding the cables into an external stripping device is eliminated.

Another principal feature of the connector is that it promotes time efficiencies in the two termination processes (shield connection and conductor connection) despite its simple terminal structures. One preferred method of rapidly making the shield connection step is shown in FIG. 5. A conductive ground bar 62 is positioned across the exposed metallic shields 74 and bare conductor wires 65, after a layer of solder has been predeposited on the ground bar 62. The electrical connections may then be made permanent simultaneously by pressing a hot reflow iron against the top of the ground bar.

A preferred method of rapidly performing the conductor connection step is to predeposit a layer of solder on the contact areas 51 of the signal terminals 50 and reference terminals 60 and, thereafter, to simultaneously press each of the aligned center conductors 71 and bare conductor wires 65 against a respective signal terminal 50 or reference terminal 60 using a hot iron reflow bar. The same hot iron reflow bar may be used for the shield connection step and the conductor connection step, thus saving on equipment expense. A related method, which also connects each conductor 71 and 65 at the same instant in time, is hot gas reflow soldering.

An alternative method of rapidly performing the conductor connection step, but which does not connect each conductor 71 and 65 at the same time, is to use an indexing method, such as laser welding, capacitive discharge welding, electrical discharge welding, or hot solder drop. Here the connecting equipment successively passes from one indexed contact area 51 to another. While the conductors are not connected at the same time, the conductor connection step is substantially simultaneous because every conductor 71 or 65 is connected in a single step without interposed conductor alignment or preparation steps Soldering remains the preferred mode of connecting, as opposed to forms such as crimping or inner dielectric penetration, because with soldering there is open viewability for quality inspection of the solder joints and the surfaces of the conductors 71 are not penetrated.

It will therefore be appreciated that the aforementioned and other desirable objects have been achieved; however, it should be emphasized that the particular embodiment of the invention, which is shown and described herein, is intended as merely illustrative and not as restrictive of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited by the claims which follow.

What is claimed is:

1. An apparatus for terminating conductors having respective elongate contact portions comprising:

(a) a connector body having spaced-apart terminals, said terminals including generally planar contact areas arranged in a common plane in separated, side-to-side relation to each other;

(b) retainer means on said connector body and separate from said terminals for accepting said conductors and for holding each conductor by separate frictional engagement in substantially parallel, separated, side-to-side relation to each other so that the side-to-side separation between respective conductors is established by said retainer means and corresponds to the side-to-side separation between respective ones of said contact areas of said spaced-apart terminals and so that said contact portions are connectible with said contact areas while said retainer means maintains said contact portions in substantially parallel relation to said common plane of said contact areas.

2. An apparatus for terminating conductors as recited in claim 1 wherein said retainer means comprises a comb-shaped member having a plurality of teeth with open-ended slots defined therebetween for holding the respective conductors by separate frictional engagement between respective pairs of said teeth.

3. An apparatus for terminating conductors as recited in claim 1, said retainer means including a cable supporting surface, and said connector body including means for offsetting said terminals from said supporting surface in a direction transverse to the parallel direction in which said cables are held by said retainer means.

4. An apparatus for terminating conductors as recited in claim 1 wherein said connector body comprises a dielectric board and wherein said spaced-apart terminals comprise substantially flat, strip-like surfaces on said dielectric board.

5. An apparatus for terminating conductors as recited in claim 1 wherein said connector body comprises a dielectric board, and wherein said spaced-apart terminals comprise conductive material deposited on said dielectric board.

6. An apparatus for terminating conductors as recited in claim 1 wherein said connector body includes means for maintaining said retainer in stationary position relative to said terminals while electrical connection is established between said conductors and respective ones of said contact areas.

7. An apparatus for terminating conductors as recited in claim 1 wherein said connector body includes means for exposing all of said contact areas simultaneously to access from a location external to said connector body, while said conductors are held by said retainer means in alignment for connection with said contact areas of said spaced-apart terminals.

8. A method for terminating an array of conductors having respective elongate contact portions at a connector, said method comprising the steps of:

(a) providing a retainer;

(b) providing a connector having strip-like terminals separate from said retainer, said terminals including generally planar contact areas arranged in a common plane in separated, side-to-side relation to each other;

(c) guiding a plurality of said conductors into said retainer and frictionally holding said conductors substantially parallel in separated, side-to-side relation to each other by means of said retainer;

(d) aligning respective ones of said conductors with respective ones of said terminals by means of said retainer so that the side-to-side separation between respective ones of said conductors is established by said retainer and corresponds to the side-to-side separation between respective ones of said contact areas, and so that said contact portions of said conductors are in substantially parallel relation to said common plane of said contact areas; and (e) thereafter, electrically connecting respective contact portions of respective ones of said conductors substantially simultaneously to said contact areas of said terminals while maintaining said contact portions of said conductors, by means of said retainer, in substantially parallel relation to said common plane of said contact areas.

9. A method as recited in claim 8 wherein step (c) includes holding each of a plurality of said conductors by separate frictional engagement in substantially parallel relation to each other by means of said retainer.

10. A method as recited in claim 8, including mounting said retainer on said connector prior to steps (c) and (d), and thereafter performing step (d) concurrently with step (c).

11. A method as recited in claim 8 wherein step (a) includes providing a retainer having a plurality of teeth with open-ended slots defined therebetween and wherein step (c) includes holding the respective conductors by separate frictional engagement between respective pairs of said teeth.

12. A method as recited in claim 8, said method further comprising the step of predepositing a layer of solder on said strip-like terminals prior to connecting said conductors thereto.

13. A method as recited in claim 8 wherein step (e) includes electrically connecting said conductors to said terminals by heating said conductors and terminals.

14. A method as recited in claim 8, further comprising surrounding each of said conductors coaxially with a respective metallic shield.

15. A method as recited in claim 14, further comprising the step of electrically connecting all of the metallic shields simultaneously to said terminals.

16. A method as recited in claim 15 wherein said step of electrically connecting all of the metallic shields comprises interconnecting the metallic shields by positioning a conductive strip in abutment with all of said metallic shields.

17. A method as recited in claim 16, said method further comprising the step of heating both the respective conductor-to-terminal connections and the respective conductive strip-to-metallic shield connections with the same heating instrument.

18. A method for terminating an array of conductors at a connector, said method comprising the steps of:

(a) providing a retainer;

(b) providing a connector having terminals;

(c) guiding a plurality of conductors, each having surrounding dielectric material, into said retainer and frictionally holding said conductors substantially parallel to each other by means of said retainer;

(d) thereafter, removing said dielectric material from the conductors by means other than said terminals while the conductors are held substantially parallel to each other by said retainer so as to prepare the conductors for electrical connection to the terminals of said connector;

(e) aligning respective ones of said conductors with respective ones of said terminals by means of said retainer; and (f) thereafter, electrically connecting said conductors to said terminals.

19. A method as recited in claim 18 wherein said step of removing dielectric material includes stripping said dielectric material off of said conductors with heat.

20. A method as recited in claim 18 wherein said step of removing dielectric material includes cutting said dielectric material off of said conductors.

21. A method as recited in claim 18 wherein step (c) includes holding each of a plurality of conductors by separate frictional engagement by means of said retainer.

22. A method as recited in claim 18, including mounting said retainer on said connector prior to steps (c), (d) and (e), and performing step (e) concurrently with step (c).

23. A method as recited in claim 18, further comprising surrounding each of said conductors coaxially with a respective metallic shield and separating each conductor and shield with said dielectric material.

24. A method as recited in claim 18, further comprising surrounding each of said conductors coaxially with a respective metallic shield and surrounding each shield with said dielectric material, wherein said step of removing dielectric material includes directing a laser beam at said dielectric material to form apertures therein so as to expose each metallic shield.

25. A method for terminating an array of conductors having respective elongate end portions at a connector, said method comprising the steps of:

(a) providing a retainer;

(b) providing a connector having strip-like terminals separate from said retainer;

(c) guiding a plurality of said conductors into said retainer and holding each conductor by separate frictional engagement by means of said retainer so that said conductors are substantially parallel to each other;

(d) aligning respective end portions of said conductors with respective terminals by means of said retainer; and (e) thereafter, electrically connecting said respective end portions of said conductors substantially simultaneously to said respective terminals by heating action.

* * * * *